US006570117B2

(12) United States Patent
Demissy et al.

(10) Patent No.: US 6,570,117 B2
(45) Date of Patent: May 27, 2003

(54) AIR-INSULATED HIGH-VOLTAGE DISCONNECTOR

(75) Inventors: Daniel Demissy, St Bernard de Lacolle (CA); Anh-Dung Huynh, Montréal (CA); Richard Marchand, Beauharmois (CA)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/021,068

(22) Filed: Dec. 19, 2001

(65) Prior Publication Data

US 2002/0092828 A1 Jul. 18, 2002

(30) Foreign Application Priority Data

Jan. 12, 2001 (FR) ..... 01 00425

(51) Int. Cl.[7] ..... H01H 33/18
(52) U.S. Cl. ..... 218/22; 200/48 A
(58) Field of Search ..... 200/48 A, 48 R; 218/30–33

(56) References Cited

U.S. PATENT DOCUMENTS 2,733,322 A 1/1956 Curtis
2,745,919 A 5/1956 Hollander
2,963,560 A 12/1960 Koerner et al.
3,544,742 A * 12/1970 Flink ..... 200/48 A
4,379,956 A * 4/1983 Cleaveland et al. ..... 200/48 A
5,198,630 A * 3/1993 Demissy et al. ..... 218/143
5,228,559 A * 7/1993 Demissy ..... 200/48 A

FOREIGN PATENT DOCUMENTS

DE 10 22 299 B 1/1958
DE 19 28 922 A 12/1970

* cited by examiner

*Primary Examiner*—Elvin Enad
*Assistant Examiner*—M. Fishman
(74) *Attorney, Agent, or Firm*—Sughrue Mion, PLLC

(57) ABSTRACT

An air-insulated high-voltage disconnector includes a pivoting arm which pivots at one end about a horizontal axis perpendicular to the axis of the arm and turns about its axis. The free end of the arm carries a contact member referred to as the hammer cooperating, in the closed position of the disconnector, with a jaw including a jaw support to which are fixed two facing rows of contact fingers. The contact fingers are tubular and open at both ends.

10 Claims, 7 Drawing Sheets

AIR-INSULATED HIGH-VOLTAGE DISCONNECTOR

BACKGROUND OF THE INVENTION

1. Field of the Invention

The present invention relates to an air-insulated high-voltage disconnector.

2. Description of the Prior Art

A disconnector includes an arm, often referred to as the blade, pivoting about a horizontal axis and electrically connected at one of its ends to a first connector disposed at the top of a first column insulator; the other end of the arm, its free end, includes a contact part, called the hammer, which, in the closed position of the disconnector, cooperates with a jaw connected to a second connector disposed at the top of a second column insulator.

When the disconnector is closed, by lowering the pivoting arm, the arm rotates 90° about its axis and the hammer therefore comes into contact with the contact parts of the jaw.

The jaw consists of two facing parallel rows of contact members each taking the form of a pair of copper blades fixed to a jaw support. The hammer which extends the arm at its end is a heavy and costly bronze component whose section in a plane perpendicular to the axis of the arm corresponds to a circle of smaller diameter than the arm and which is flattened along one diameter, which is extended to merge with a diameter of the arm, the two diametral extensions having rounded edges and a thickness from 2 to 3 mm.

French patent 2 674 985 describes a disconnector of the above kind.

SUMMARY OF THE INVENTION

The present invention proposes to improve certain aspects of a disconnector of the above type and provides an air-insulated high-voltage disconnector including a pivoting arm which is adapted to pivot at one of its ends about a horizontal axis perpendicular to the axis Δ of the arm and to turn about its axis Δ, the free end of the arm carrying a contact member referred to as the hammer cooperating, in the closed position of the disconnector, with a jaw including a jaw support to which are fixed two facing rows of tubular contact fingers open at both ends.

According to another feature, the facing fingers have an angle $\phi$ between them from 2° to 6°.

According to another feature, the contact fingers are fixed to the jaw support so that, in the closed position of the disconnector, the angle E between the axis Δ of the arm and the contact fingers is greater than 90°.

According to another feature, the hammer is equipped with contact plates cooperating with the contact fingers, each contact plate forming a wedge of angle $\beta$ which, when the disconnector is closed, encounters the corresponding row of fingers with an angle of attack $\alpha$ less than 90°.

Each contact plate advantageously has a curved contact face subtending an angle $\delta$ of the order of 17° as seen from the axis Δ of the arm.

According to another feature, at the moment the wedge of a contact plate comes into contact with one of the contact fingers, the angle $\gamma$ as seen from the axis Δ of the arm between that contact point and the plane perpendicular to the contact finger passing through the axis Δ is of the order of 10°.

One embodiment of the invention will now be described with reference to the accompanying drawings.

DETAILED DESCRIPTION OF THE PREFERRED EMBODIMENT

Figure 1:
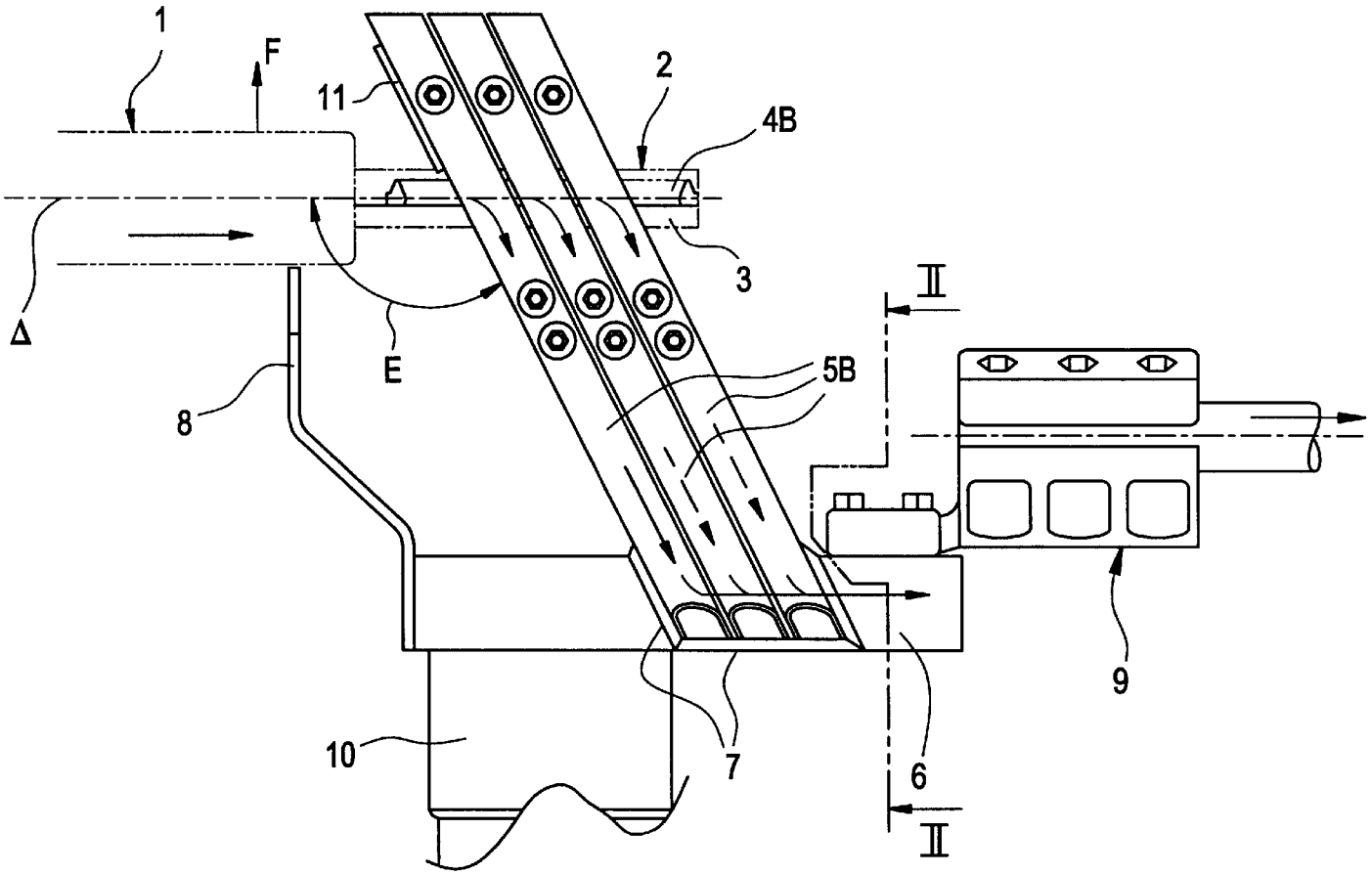
FIG. 1 is a partial view of a disconnector according to the invention, as seen from the left in FIG. 2.

FIGS. 1 to 6 show part of a disconnector which has a pivoting arm 1 adapted to pivot in a vertical plane about a horizontal axis, not shown, which is perpendicular to its axis A and situated to the left of the components shown in FIG. 1. The part of the arm that is not shown, the means for pivoting it about said horizontal axis, the means for rotating it about its axis Δ, and its support means do not form any part of the invention and can be as described in French patent 2 674 985 with reference to FIG. 1 thereof, for example.

Figure 2:
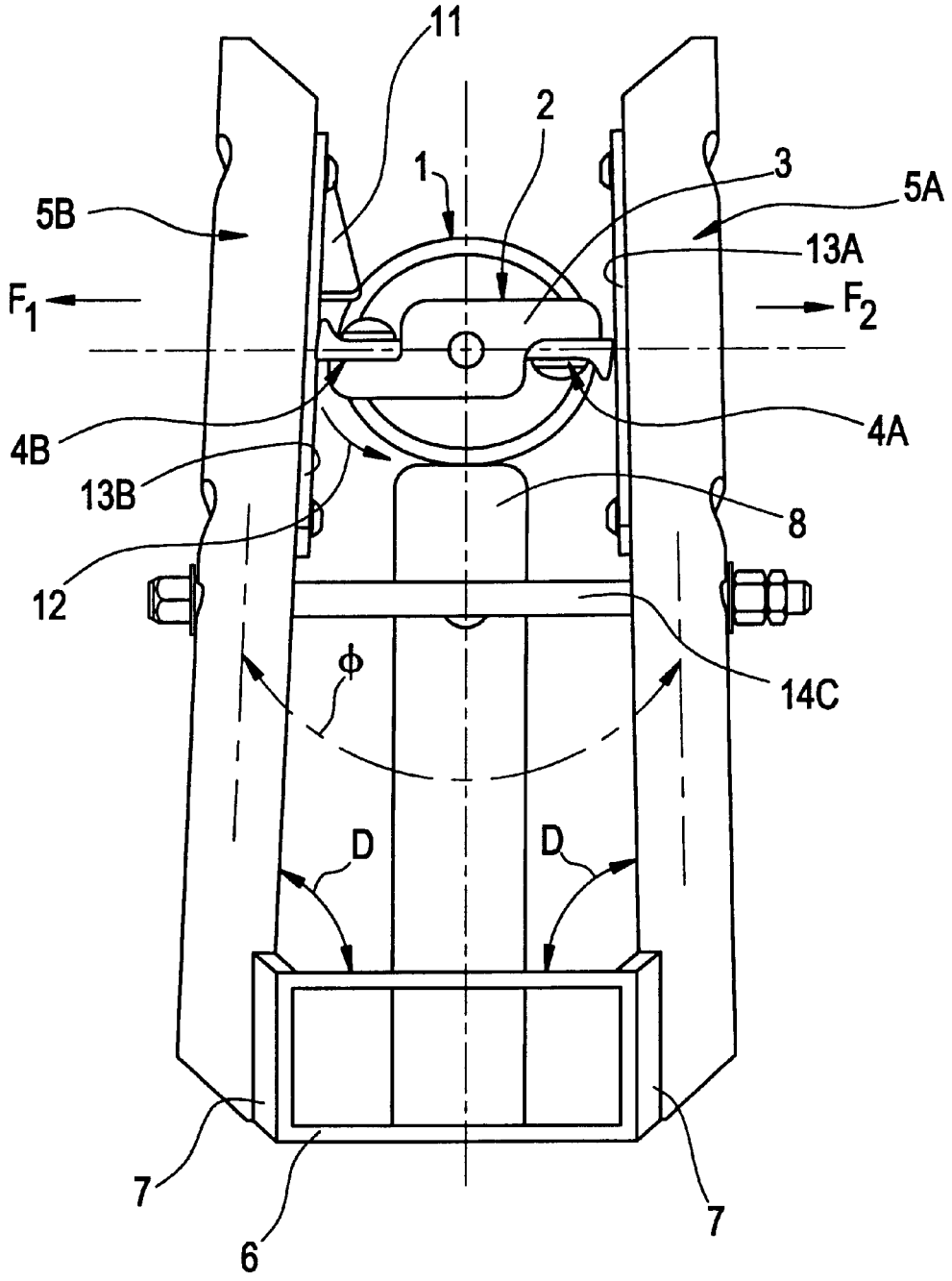
FIG. 2 is a view in section taken along the line II—II in FIG. 1.

The arm 1 is tubular, as can be seen clearly in FIG. 2, and carries at its free end a contact member 2 called the hammer.

The hammer includes an aluminum support part 3 to which are fixed two copper contact plates 4A and 4B. This reduces the weight of the hammer.

The contact plates 4A and 4B have a particular shape, explained later, and constitute contact members cooperating, in the closed position of the disconnector, with two facing rows of contact fingers 5A and 5B of the jaw of the disconnector.

The fingers 5A and 5B are fixed to a jaw support 6 by a weld 7. An abutment 8 for limiting the penetration of the arm 1 between the fingers 5A and 5B of the jaw is fixed to the jaw support 6. A connector 9 is also fixed to the jaw support 6. A second connector, not shown, is electrically connected to the end of the arm 1 that is not shown, at which it is articulated about a horizontal axis.

The jaw is supported at the top end of a support insulator of which only the top end fitting 10 can be seen in FIG. 1.

Figure 3:
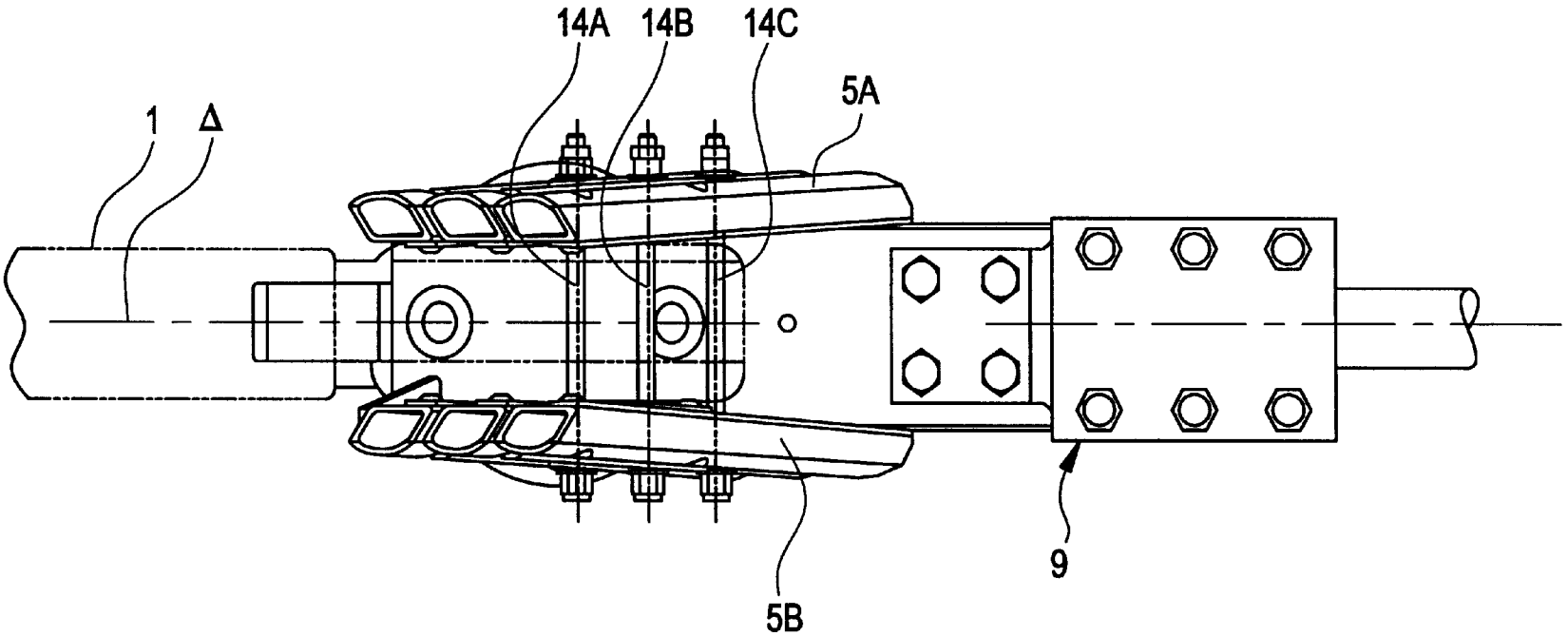
FIG. 3 is a plan view relative to FIG. 1.
Figure 4:
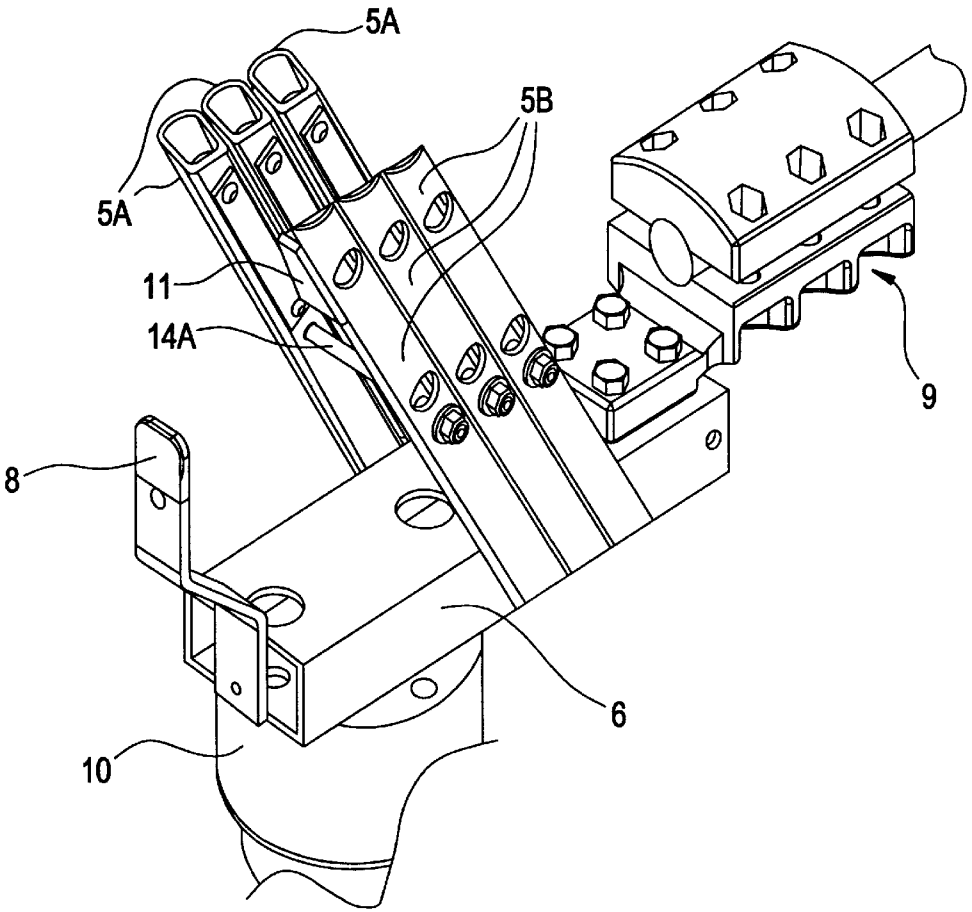
FIG. 4 is a perspective view showing the jaw of the disconnector.

FIGS. 1, 2 and 3 show the disconnector in the closed position.

Figure 7:
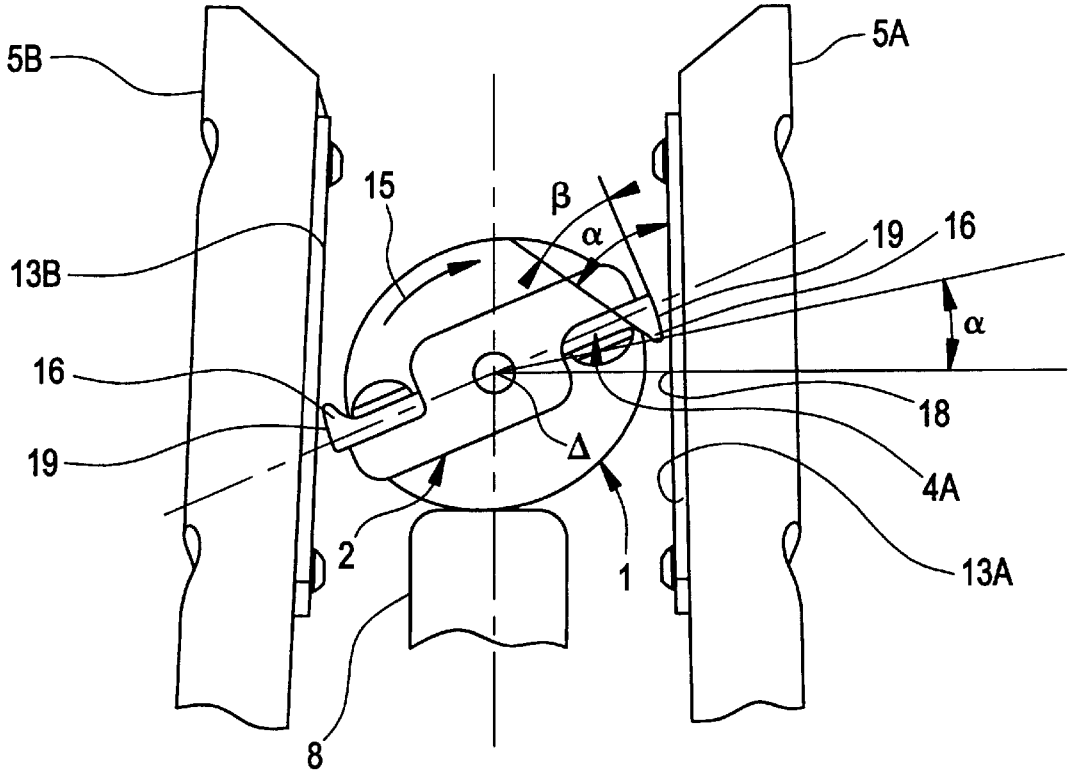
FIG. 7 is a diagram showing the angle of attack of the hammer on the contact fingers of the jaw when the hammer rotates during closing of the disconnector.

When the disconnector is to be closed, the arm 1 first pivots about its horizontal axis until, when it has pivoted through an angle of approximately 92°, it enters the jaw, between the fingers 5A and 5B, after which the arm 1 turns 90° about its axis Δ in the direction of the arrow 15 (FIG. 7). The disconnector is then in the closed position, as shown in FIGS. 1 to 3.

An electrodynamic force F tending to extract the arm 1 from the jaw is generated by the current that flows in the arm 1 and the fingers 5A and 5B, as shown by arrows with no reference numbers in FIG. 1 (the current flows in the opposite direction on the next half-cycle). This is known in the art. This force becomes very high in the event of a short circuit between phase and ground or between two phases.

To reduce the electrodynamic force the fingers 5A and 5B are fixed to the jaw support 6 so that the angle E between the axis Δ of the arm 1 in the closed position and the fingers 5A–5B is greater than 90°.

The force F is at a maximum when the fingers 5A–5B are perpendicular to the axis Δ of the arm 1 and decreases as that angle increases. At an angle E of 120°, for example, the force F is approximately 0.6 times that when the angle E is 90°.

The fingers 5A and 5B are attracted to each other because the current flows in the same direction in them; the attractive force is high in the event of a short circuit and the force F generates a force tending to pull the fingers off the jaw support.

Thus reducing the force F by making the angle E greater than 90° means that the dimensions of the jaw support can be reduced and the fingers can be fixed less strongly to the support, which reduces overall weight.

In the example shown, the angle E is approximately 120°, preferably from 100° to 140°.

As shown in FIG. 2, the fingers 5A and 5B are not parallel but at a small angle ϕ to each other of a few degrees, of the order of 2° to 6°. For example, if the fingers 5A and 5B are welded to the jaw support 6 at an angle D of 88° the angle between the fingers 5A and 5B is 4°.

Accordingly, in the event of a short circuit, the upward movement of the arm 1 is limited by this "cone effect", which holds the hammer between the fingers and tends to increase the contact pressure during movements within the disconnector caused by said electrodynamic force.

To limit further the upward movement of the hammer between the fingers 5A and 5B in the event of a short circuit, a locking abutment 11 is fixed to a contact finger 5B at a level higher than the hammer 2 in the closed position of the disconnector.

The abutment 11 represents no impediment to opening the disconnector because opening begins with 90° rotation of the hammer 2 in the direction of the arrow 12 (FIG. 2) before the arm 1 pivots about a horizontal axis perpendicular to the plane of FIG. 1.

As already mentioned, the facing fingers 5A and 5B are fixed to the jaw supports 6 by the weld 7 at the angles E and D and have a tubular profile open at both ends so as to induce heat exchange by convection within the tube. The fingers are made of aluminum and have on the side facing toward the facing row copper contact blades 13A, 13B cooperating directly with the copper contact plates 4A, 4B of the hammer 2.

This disposition with tubular aluminum fingers equipped with copper contact blades greatly reduces the weight of the contact fingers compared to the curved copper blades of the prior art document cited in the introduction, with improved thermal performance and sufficient stiffness of the fingers to require no additional spring, as is generally necessary in the prior art, where a spring is disposed between the jaw support and the curved portion of the curved copper blade, to impart sufficient stiffness to it.

Respective retaining rods 14A, 14B and 14C substantially halfway along the contact fingers SA, 5B connect the fingers 5A and 5B in pairs to limit their separation.

When the arm 1 rotates in the direction of the arrow 15 (FIG. 7) at the end of closing of the disconnector, the fingers 5A, 5B flex, forming springs between the rods 14A, 14B and 14C and the top end of the fingers, so that each finger auto-locates against the copper contact plates 4A and 4B of the hammer 2, thereby optimizing the line of contact between the hammer and the fingers.

Note that in the event of a short circuit between phases, the arm 1 is subject to an electrodynamic force causing lateral displacement in the direction $F_1$ or $F_2$ (FIG. 2), according to whether the short circuit is on a phase to the right or to the left of the phase including the disconnector described. Because of the spring effect of the fingers and the retaining rods 14A, 14B and 14C, this movement does not break the contact between the contact parts 4A and 4B of the hammer and the contact blades 13A, 13B of the fingers.

Figure 5:
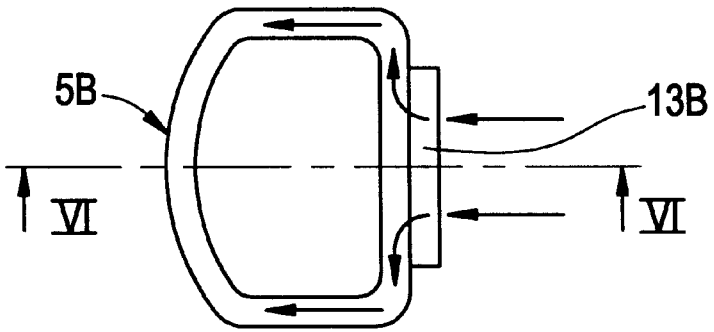
FIG. 5 shows the section of a contact finger of the jaw.
Figure 6:
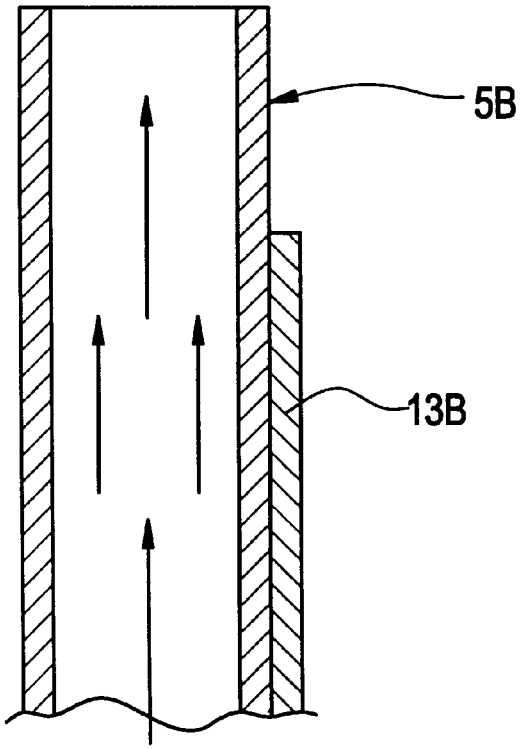
FIG. 6 is a section taken along the line VI—VI in FIG. 5.

FIG. 5 shows the section of a finger, for example the finger 5B, and FIG. 6 shows the same finger in section taken along the line VI—VI in FIG. 5.

FIG. 7 shows the position of the hammer 2 when, during closing, and the arm 1 having started to descend and rotate about its axis A, the end of the copper contact plates 4A and 4B of the hammer comes into contact with the copper contact plates 13A and 13B of the contact fingers 5A, 5B.

As shown in FIG. 7, at the moment of contact, the plates, which have an end forming a wedge 16 with an angle β, encounter the fingers with an angle of attack α less than 90° and preferably of the order of 60°, and break any ice that may have formed on the contact blades 13A, 13B. The angle β of the wedge 16 is of the order of 30° to 40°, for example.

Figure 8:
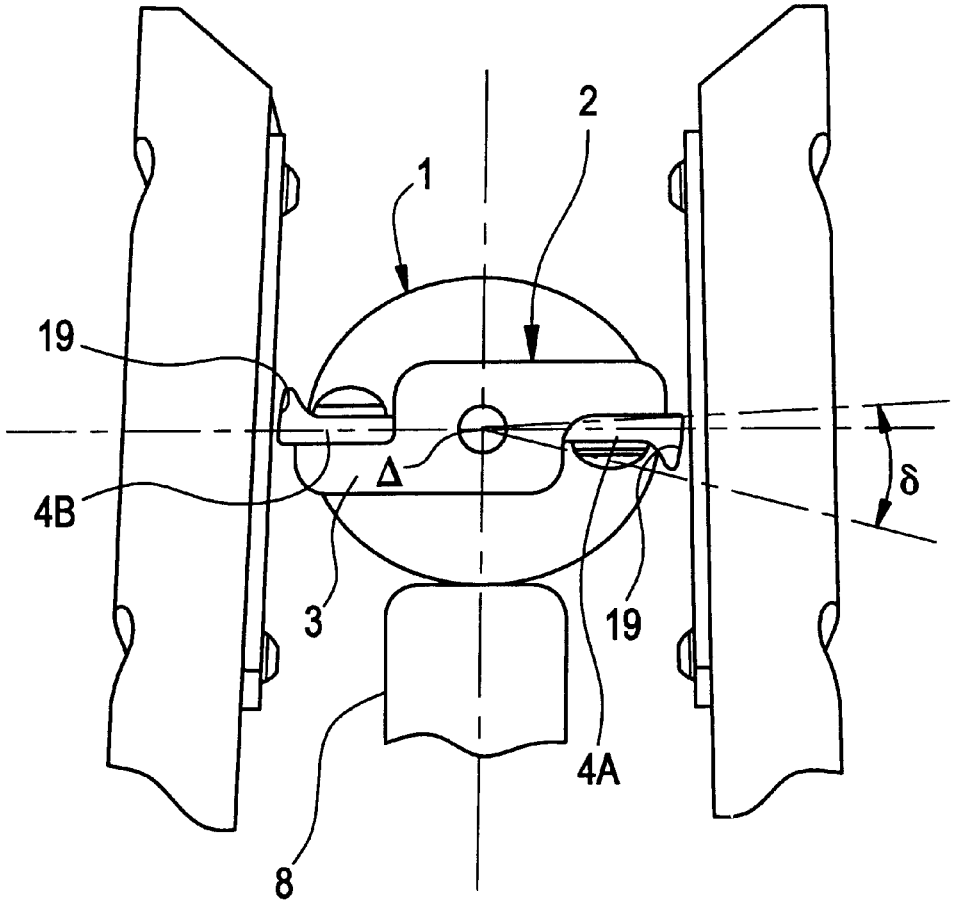
FIG. 8 is a diagram showing the angular range of constant pressure contact of the fingers of the jaw against the hammer.

The above contact occurs when the distance between the axis Δ and the tip of the wedge 16 is greater than the distance between the axis A and the fingers 13A, 13B so that, from this time, and until the tip of the wedge 16 reaches the point 18, which corresponds to rotation through an angle γ of approximately 10°, the contact plates 4A, 4B push back the fingers 5A, 5B acting as springs, the contact pressure increasing up to this point. Then, the contact face 19 being curved, the contact pressure remains substantially constant during rotation through an angle δ (FIG. 8) of approximately 17°, corresponding to the angle δ subtended by the contact surface 19 of the contact plates 4A, 4B as seen from the axis Δ. This range of constant pressure contact over an angle δ of approximately 17° compensates angular offsets originating in deficient adjustment or loss of precision caused by wear of the components.

What is claimed is:

1. An air-insulated high-voltage disconnector including a pivoting arm which is adapted to pivot at one of its ends about a horizontal axis perpendicular to the axis Δ of the arm and to turn about said axis Δ, the free end of said arm carrying a contact member referred to as the hammer cooperating, in the closed position of said disconnector, with a jaw including a jaw support to which are fixed a plurality of tubular contact fingers open at both ends and forming two opposed rows.

2. The disconnector claimed in claim 1, wherein said opposed rows have an angle ϕ between them from 2° to 6°.

3. The disconnector claimed in claim 1, wherein said opposed rows are fixed to said jaw support so that, in said closed position of said disconnector, the angle E between said axis Δ of said arm and said opposed rows is greater than 90°.

4. The disconnector claimed in claim 3, wherein said angle E is from 100° to 140°.

5. The disconnector claimed in claim 1, wherein said tubular contact fingers are made of aluminum and each carries on the side facing toward the opposed row a copper contact blade.

6. The disconnector claimed in claim 1, wherein said tubular contact fingers are fixed to said jaw support by a weld.

7. The disconnector claimed in claim 1, wherein a retaining rod halfway along said tubular contact fingers connects each pair of opposed tubular contact fingers.

8. The disconnector claimed in claim 1, wherein said hammer is equipped with contact plates cooperating with said tubular contact fingers, each contact plate forming a wedge of angle $\beta$ which, when said disconnector is closed, encounters a corresponding row of tubular contact fingers with an angle of attack $\alpha$ less than 90°.

9. The disconnector claimed in claim 8, wherein each contact plate has a curved contact face subtending an angle $\delta$ of the order of 17° as seen from the axis $\Delta$ of the arm.

10. The disconnector claimed in claim 8, wherein at the moment said wedge of a contact plate comes into contact with one of said tubular contact fingers, the angle $\gamma$ as seen from said axis $\Delta$ of said arm between that contact point and the plane perpendicular to the contacted contact finger and passing through said axis $\Delta$ is of the order of 10°.

* * * * *